US010180100B2

(12) United States Patent
Suzuki

(10) Patent No.: US 10,180,100 B2
(45) Date of Patent: Jan. 15, 2019

(54) COOLING SYSTEM AND OPERATION METHOD OF ELECTRIC OIL PUMP IN COOLING SYSTEM

(71) Applicant: TOYOTA JIDOSHA KABUSHIKI KAISHA, Toyota-shi, Aichi-ken (JP)

(72) Inventor: Shinjiro Suzuki, Kariya (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 324 days.

(21) Appl. No.: 14/573,054

(22) Filed: Dec. 17, 2014

(65) Prior Publication Data

US 2015/0184577 A1 Jul. 2, 2015

(30) Foreign Application Priority Data

Dec. 26, 2013 (JP) ..... 2013-268384

(51) Int. Cl.
*F04B 49/02* (2006.01)
*F01P 7/16* (2006.01)
*F04D 15/00* (2006.01)

(52) U.S. Cl.
CPC ..... *F01P 7/16* (2013.01); *F04B 49/02* (2013.01); *F04D 15/0077* (2013.01); *F04D 15/0088* (2013.01)

(58) Field of Classification Search
CPC ..... F04D 15/0263; F04D 15/0281; F04D 15/0088; F04D 15/0077; F04D 25/06; F01P 7/16; F01P 5/14; F01P 2005/125; F01P 2060/04; F04C 28/06; F04B 2207/03; F04B 49/02; F04B 49/06; F04B 49/065; F04B 2205/14; F01M 1/00; F01M 1/02; F01M 1/0215; F01M 1/0238; H02K 9/19
USPC ..... 701/33.7, 33.8, 33.9; 417/32, 42
See application file for complete search history.

(56) References Cited

U.S. PATENT DOCUMENTS 5,372,213 A 12/1994 Hasebe
2003/0005751 A1* 1/2003 Berndorfer ..... G01N 33/2888 73/54.01
2005/0029024 A1* 2/2005 Takami ..... B60K 6/445 180/65.235

(Continued)

FOREIGN PATENT DOCUMENTS

DE 102011076026 A1 12/2011
EP 1 855 902 B1 2/2010

(Continued)

*Primary Examiner* — Philip Stimpert
(74) *Attorney, Agent, or Firm* — Finnegan, Henderson, Farabow, Garrett & Dunner, LLP

(57) ABSTRACT

A cooling system 100 includes an electric oil pump 18, an outside air temperature sensor 22, an oil temperature sensor 21, and a controller 30. The controller 30 permits the actuation of the electric oil pump 18 in one of a first case where an oil temperature To is equal to or greater than a first threshold (A) and where an outside air temperature Ta is equal to or greater than a second threshold (B), a second case where the outside air temperature Ta is less than the second threshold (B) and where the oil temperature To is equal to or greater than a third threshold (C) higher than the first threshold (A), and a third case where the oil temperature To is less than the first threshold (A) and where the outside air temperature Ta is equal to or greater than a fourth threshold (D) higher than the second threshold (B).

4 Claims, 3 Drawing Sheets

(56) References Cited

U.S. PATENT DOCUMENTS

| | | | | |
|---|---|---|---|---|
| 2008/0109129 | A1* | 5/2008 | Yanagida | B60K 6/365 701/31.7 |
| 2011/0139133 | A1* | 6/2011 | Surnilla | F02D 41/0055 123/568.12 |
| 2013/0078111 | A1* | 3/2013 | Okamoto | F04B 49/02 417/32 |

FOREIGN PATENT DOCUMENTS

| | | |
|---|---|---|
| JP | 2005-169985 | 7/1993 |
| JP | 2005-245085 | 9/2005 |
| JP | 2005-299450 | 10/2005 |
| JP | 2006-254616 | 9/2006 |
| JP | 2012-57645 | 3/2012 |
| JP | 2013-68267 | 4/2013 |
| JP | 2013-207957 | 10/2013 |

* cited by examiner

COOLING SYSTEM AND OPERATION METHOD OF ELECTRIC OIL PUMP IN COOLING SYSTEM

PRIORITY INFORMATION

The entire disclosure of Japanese Patent Application No. 2013-268384, filed on Dec. 26, 2013, including the specification, claims, drawings, and abstract, is incorporated herein by reference in its entirety.

TECHNICAL FIELD

The present invention relates to a structure of a cooling system which circulates cooling oil by an electric oil pump, and to an operation method of the electric oil pump.

BACKGROUND ART

In an electric vehicle using a motor as a driving source, motor cooling oil is often circulated by an electric oil pump to cool a stator or a rotor. However, if the electric oil pump is operated in to situation where the temperature of the motor does not rise at a low outside air temperature, mileage per charge is reduced. Therefore, a method that keeps the electric oil pump out of operation in this case has been suggested (e.g., see JP 2005-245085 A1).

According to another suggestion, when the outside air temperature is low, it is assumed that the viscosity of the cooling oil is high, and activation of the electric oil pump for circulating the motor cooling oil is attempted. Even when the electric oil pump cannot be activated by more than one attempt, the electric oil pump is not judged to be abnormal, so that erroneous detection of the electric oil pump abnormality is suppressed (e.g., see JP 2006-254616 A1).

In a system which supplies the oil pressure of control oil for a gearless drive mechanism, the oil temperature of the control oil may be lower than the oil temperature in an oil pan disposed in an oil temperature sensor. In this case, even when an oil temperature detected by the oil temperature sensor is an oil temperature that enables activation, the oil temperature of the control oil inside the oil pump which supplies the control oil pressure is not the oil temperature that enables activation, and a brushless motor for oil pump driving may step out. A method is thus suggested to activate the electric oil pump a predetermined time after the temperature of the control oil in the oil pan has reached the temperature that enables activation (e.g., see JP 2012-057645 A1).

Another method has been suggested. The oil temperature sensor has measurement error. Therefore, when it is not possible to judge whether the actual oil temperature is within a temperature range that enables activation of the electric oil pump in view of the measurement error, the fault judgment is invalidated, and trial running of the electric oil pump is carried out with a drive electric current and a desired rotation speed that are restricted compared with those in normal running. When a rotation speed equal to or greater than a predetermined rotation speed cannot be reached, the pump is deactivated. When the rotation speed equal to or greater than the predetermined rotation speed has been reached, the fault judgment is permitted, and the pump is driven under instruction. In this way, the accuracy of pump fault diagnosis is enhanced (e.g., see JP 2013-058267 A1).

SUMMARY OF THE INVENTION

In the meantime, whether the electric oil pump can be activated is often determined by whether the oil temperature of the cooling oil inside the electric oil pump is equal to or greater than a predetermined oil temperature and by whether the viscosity of the cooling oil is equal to or less than a predetermined viscosity. However, it is difficult to directly measure the oil temperature inside the electric oil pump, and providing the temperature sensor in the vicinity of the electric oil pump only to judge the activation of the pump leads to the problem of complication of a cooling system.

Accordingly, the conventional arts described in JP 2005-245085 A1 and JP 2006-254616 A1 judge permission for the activation of the electric of pump by the outside air temperature, and the conventional arts described in JP 2012-057645 A1 and JP 2013-068267 A1 judge permission for the activation of the electric oil pump by using an oil temperature measured in a place different from the place where the oil pump is located or by using an oil temperature having a wide margin of measurement error.

However, the control according to these conventional arts has the following problems: A fault is detected in the electric oil pump even if it is not faulty (erroneous detection of a fault), or the operating temperature region of the electric oil pump is excessively restricted to ensure the activation of the electric oil pump.

It is therefore an object of the present invention to use a simple configuration to suppress erroneous detection of an electric oil pump fault and to widen the operable region of the electric oil pump.

Solution to the Problems

According to the present invention, there is provided a cooling system including an electric oil pump which circulates cooling oil, an outside air temperature sensor which detects an outside air temperature, an oil temperature sensor which detects an oil temperature of the cooling oil, and a controller which judges permission for the actuation of the electric oil pump. The controller has electric oil pump actuation permitting means for permitting the actuation of the electric oil pump in one of a first case where the oil temperature detected by the oil temperature sensor is equal to or greater than a first threshold and where the outside air temperature detected by the outside air temperature sensor is equal to or greater than a second threshold, a second case where the outside air temperature is less than the second threshold and where the oil temperature is equal to or greater than a third threshold higher than the first threshold, and a third case where the oil temperature is less than the first threshold and where the outside air temperature is equal to or greater than a fourth threshold higher than the second threshold.

In the cooling system according to the present invention, it is preferable that the controller activates the electric oil pump and judges the abnormality of the electric oil pump and that the controller has electric oil pump abnormality judging means for continuing the actuation of the electric oil pump without judging the abnormality of the electric oil pump when the electric oil pump is not activated by an activation instruction for the electric oil pump in the second case and the third case.

In the cooling system according to the present invention, it is preferable that the electric oil pump is disposed outside a case to store a vehicle driving motor, and the electric oil pump circulates the cooling oil in the case through the motor, that the oil temperature sensor detects the oil temperature of the cooling oil in the case, and that the electric oil pump and the case are connected by an external pipe outside the case.

According to the present invention, there is provided an operation method of an electric oil pump in a cooling system. The cooling system includes an electric oil pump which is disposed outside a case to store a vehicle driving motor and which circulates the cooling oil in the case through the motor, an outside air temperature sensor which detects an outside air temperature, and an oil temperature sensor which detects an of temperature of the cooling oil in the case. The electric of A pump and the case are connected by an external pipe outside the case. The method includes permitting the actuation of the electric oil pump in one of a first case where the oil temperature detected by the oil temperature sensor is equal to or greater than a first threshold and where the outside air temperature detected by the outside air temperature sensor is equal to or greater than a second threshold, a second case where the outside air temperature is less than the second threshold and where the oil temperature is equal to or greater than a third threshold higher than the first threshold, and a third case where the oil temperature is less than the first threshold and where the outside air temperature is equal to or greater than a fourth threshold higher than the second threshold.

In the operation method of the electric oil pump according to the present invention, it is preferable that the actuation of the electric oil pump is continued without a judgment of the abnormality of the electric oil pump when the electric oil pump is not activated by an activation instruction for the electric oil pump in the second case and the third case.

According to the present invention, there is provided a cooling system including an electric oil pump which circulates cooling oil, an outside air temperature sensor which detects an outside air temperature, an oil temperature sensor which detects an oil temperature of the cooling oil, and a controller which includes a CPU and which judges permission for the actuation of the electric oil pump. The CPU of the controller executes an electric oil pump actuation permitting program to permit the actuation of the electric of pump in one of a first case where the it temperature detected by the oil temperature sensor is equal to or greater than a first threshold and where the outside air temperature detected by the outside air temperature sensor is equal to or greater than a second threshold, a second case where the outside air temperature is less than the second threshold and where the oil temperature is equal to or greater than a third threshold higher than the first threshold, and a third case where the oil temperature is less than the first threshold and where the outside air temperature is equal to or greater than a fourth threshold higher than the second threshold.

Advantageous Effects of the Invention

The advantage of the present invention is that a simple configuration can be used to suppress erroneous detection of an electric oil pump fault and to widen the operable region of the electric oil pump.

BRIEF DESCRIPTION OF THE DRAWINGS

Preferred embodiment(s) of the present invention will be described in detail by reference to the following figures, wherein.

DESCRIPTION OF EMBODIMENT

Figure 1:
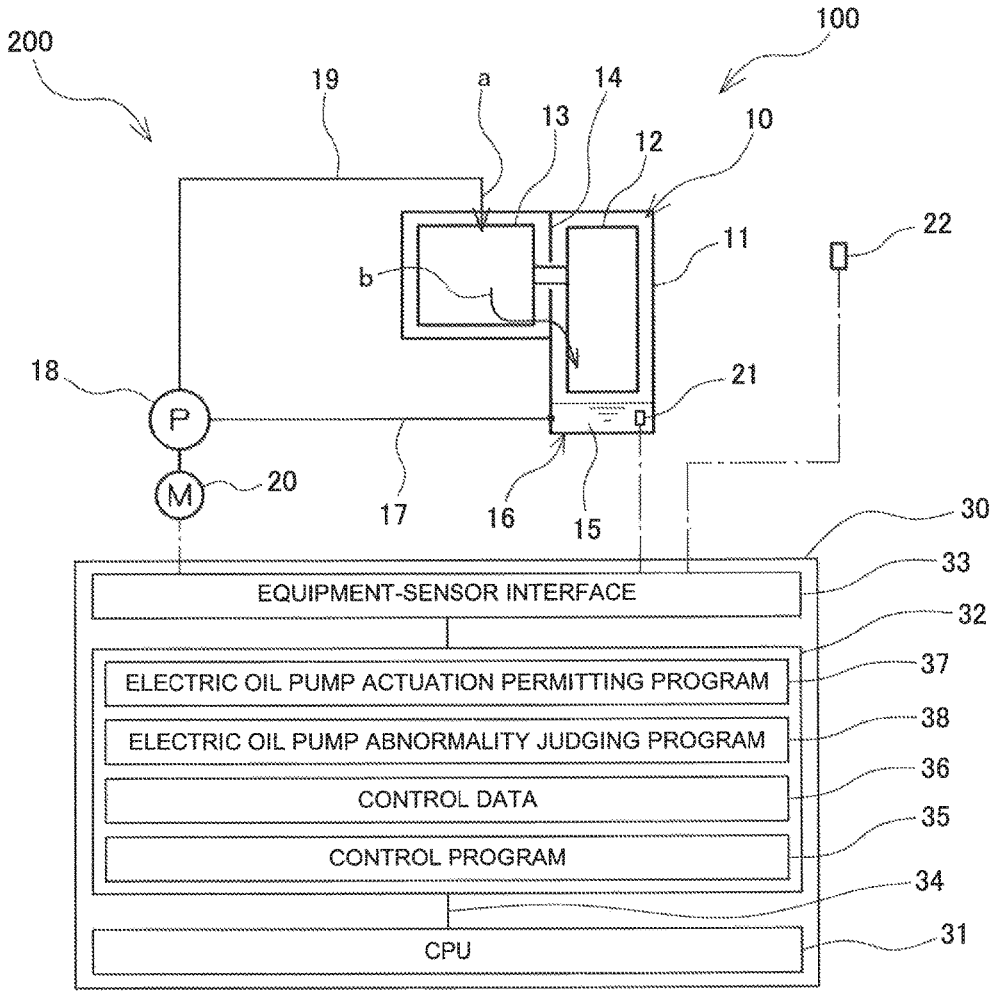
FIG. 1 is a system diagram showing the configuration of a cooling system according to an embodiment of the present invention.

An embodiment of the present invention will be described hereinafter with reference to the drawings. Although a cooling system which cools a driving motor in an electric vehicle is described below by way of example, the present invention is also applicable to an oil cooling system besides that for the electric vehicle. As shown in FIG. 1, a cooling system 100 according to the present embodiment is a cooling system which cools a motor 13 for driving an electric vehicle 200. In the electric vehicle 200, driving force of the motor 13 is transmitted to an unillustrated axle via a transaxle 12 which combines a transmission and a differential gear. The motor 13 and the transaxle 12 are stored in a one-piece case 11. A partition 14 is disposed inside the case 11 to divide a region to store the transaxle 12 and a region to store the motor 13, and a shaft of the motor 13 is connected to the transaxle 12 through the partition 14. The case 11, the transaxle 12, the motor 13, and the partition 14 together constitute a transaxle assembly 10. An oil pan 16 to retain cooling oil 15 is formed under the part of the transaxle 12 of the case 11. An electric oil pump 18 is disposed outside the transaxle assembly 10, and a suction side of the electric oil pump 18 is connected to the oil pan 16 disposed under the case 11 of the transaxle assembly 10 by an external pipe 17 (suction pipe). A discharge side of the electric oil pump 18 is connected to the upper side of the motor 13 in the transaxle assembly 10 by a discharge pipe 19. The external pipe 17 is a flexible pipe such as a rubber pressure-resistant hose, and the discharge pipe 19 is, for example, a metallic pressure-resistant pipe. While the electric vehicle 200 is running, the temperature rises to several ten degrees or more inside the transaxle assembly 10, whereas the electric oil pump 18 and the external pipe 17 that are disposed outside the transaxle assembly 10 do not reach such a high temperature and only reach a temperature slightly higher than the outside air temperature.

As shown in FIG. 1, the cooling oil 15 retained in the oil pan 16 under the case 11 of the transaxle assembly 10 is sucked into the electric oil pump 18 through the external pipe 17, increased in pressure by the electric oil pump 18, and flows into the motor 13 from the upper side of the motor 13 stored in the transaxle assembly 10 through the discharge pipe 19 (arrow a in FIG. 1). The cooling oil 15 which has flowed in the motor 13 cools a stator, a coil end, or a rotor of the motor 13, and then enters a region. on the side of the transaxle 12 of the case 11 through an unillustrated channel disposed in the partition 14 from the motor 13, and returns to the oil pan 16 disposed under the transaxle 12 (arrow b in FIG. 1). In this way, the electric oil pump 18 cools the motor 13 by circulating the cooling oil 15 retained in the oil pan 16 inside the case 11 through the motor 13. Inside the case 11, an unillustrated heat exchanger for cooling the cooling oil may be disposed, or a radiator for cooling the cooling oil may be provided along the discharge pipe 19.

As shown in FIG. 1, an oil temperature sensor 21 is installed under the cooling oil 15 retained in the oil pan 16. The oil temperature sensor 21 detects an oil temperature To of the cooling oil 15 inside the case 11. An outside air temperature sensor 22 which detects an outside air temperature Ta around the electric vehicle 200 is also installed outside the electric vehicle 200; for example, outside a fender. The electric oil pump 18 is driven by an electric motor 20 such as a synchronous motor.

As shown in FIG. 1, the cooling system 100 comprises a controller 30 which judges permission for the actuation of the electric oil pump 18, activates and deactivates the electric oil pump, and judges the abnormality of the electric it pump 18. The controller 30 includes a CPU 31 which performs calculation processing and signal processing, a storage 32 to store a control program and others, and an equipment-sensor interface 33 for input and output between. equipment and the sensors. The CPU 31, the storage 32, and the equipment-sensor interface 33 are computers connected by a data bus 34. The storage 32 stores a control program 35 which controls the overall cooling system, control data 36, an electric oil pump actuation permitting program 37 which is electric oil pump actuation permitting means, and an electric oil pump abnormality judging program 38 which is electric oil pump abnormality judging means. The oil temperature sensor 21, the outside air temperature sensor 22, and the electric motor 20 are connected to the equipment-sensor interface 33, Data detected by each of the sensors 21 and 22 are loaded into the controller 30 from the equipment-sensor interface 33. The electric motor 20 is configured to be driven under an instruction from the controller 30.

The operation of the above cooling system 100 is described with reference to FIG. 2 and FIG. 3. In FIG. 3, an intersection point P of a horizontal axis and a vertical axis indicates a temperature lower than 0° C. As shown in steps S101 and S102 in FIG. 2, the oil temperature To and the outside air temperature Ta detected by the oil temperature sensor 21 and the outside air temperature sensor 22 shown in FIG. 1 are loaded into the controller 30. The controller 30 then executes the electric oil pump actuation permitting program 37 shown in FIG. 1. The controller 30 permits the actuation of the electric oil pump 18 (finishes the electric oil pump actuation permitting program 37) as shown in step S106 in FIG. 2 in a case (first case) where the oil temperature To detected by the sensor 21 is equal to or greater than a first threshold (A) and where the outside air temperature Ta detected by the sensor 22 is equal to or greater than a second threshold (B) as shown in step S103 in FIG. 2; that is, in a case where the oil temperature To and the outside air temperature Ta are included in a region (I) shown in FIG. 3 In this case, the oil temperature To of the cooling oil 15 retained in the oil pan 16 is judged to be sufficiently high, and the viscosity of the cooling oil 15 is judged to be low enough to enable activation. Moreover, the oil temperature To of the cooling oil 15 inside the electric oil pump 18 and the external pipe 17 which are disposed outside the transaxle assembly 10 and which have a temperature close to the outside air temperature Ta is also judged to be sufficiently high, and the viscosity of the cooling oil 15 is judged to be low enough to enable activation.

Figure 2:
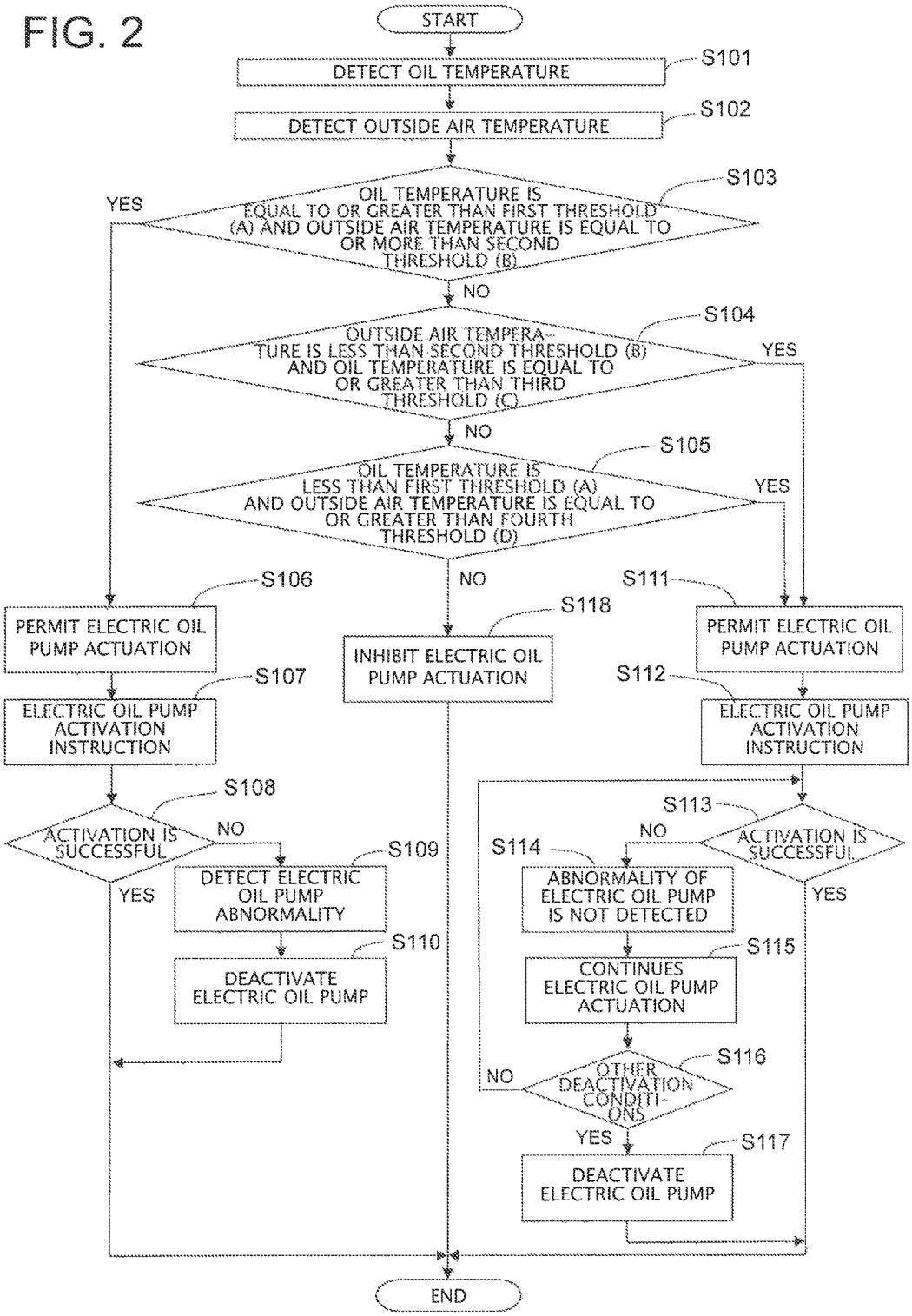
FIG. 2 is a flowchart showing the operation of the cooling system according to the embodiment of The present invention.
Figure 3:
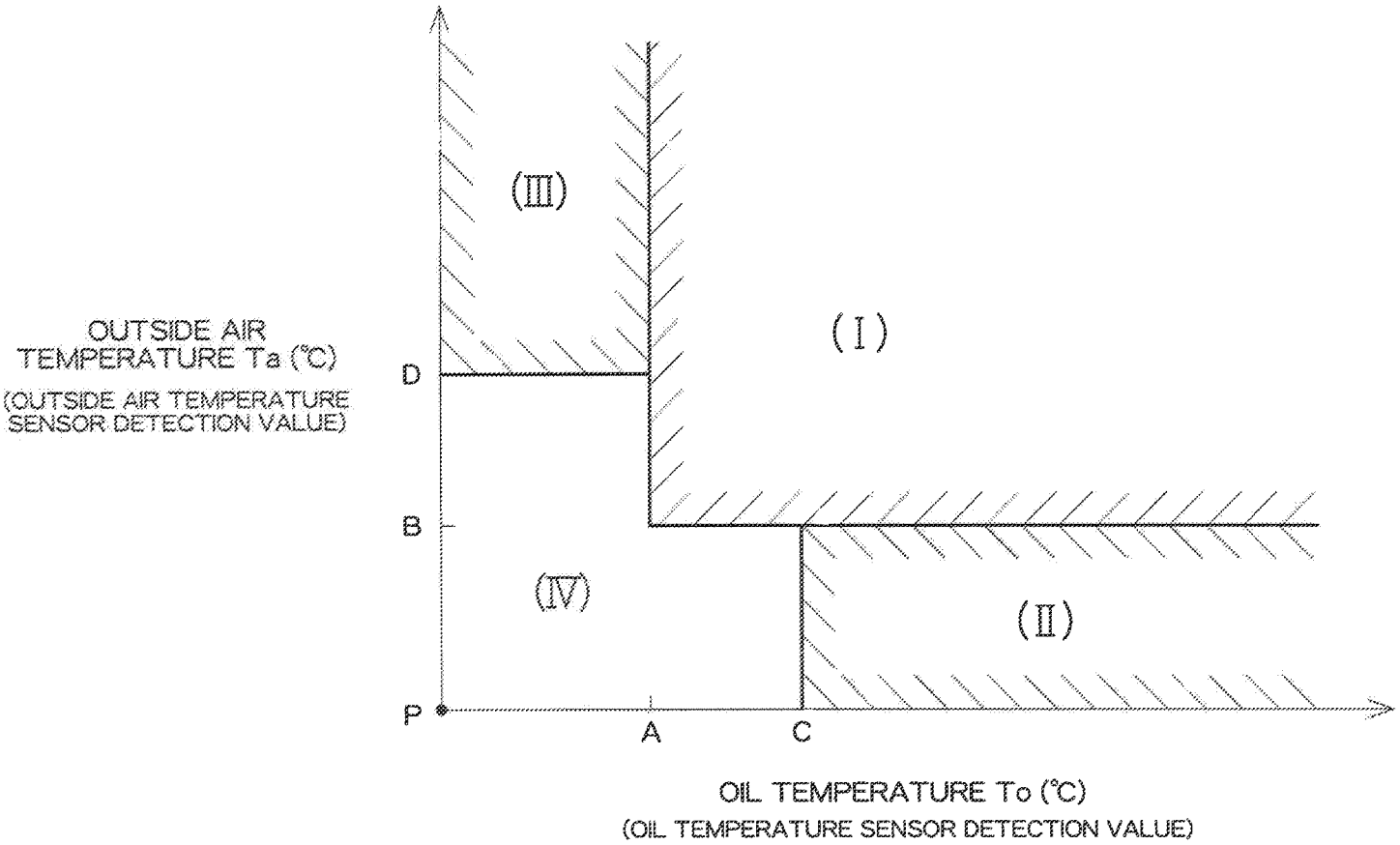
FIG. 3 is an operation map regarding the oil temperature in the cooling system and the outside air temperature according to the embodiment of the present invention.

For example, when the temperature of the motor 13 has risen and the cooling of the motor 13 is needed, the controller 30 outputs an electric oil pump activation instruction as shown in step S107 in FIG. 2. An electric current runs through the electric motor 20 under the electric oil pump activation instruction, and the electric motor 20 starts rotating. When the electric oil pump 18 rotates at a rotation speed equal to or greater than a rotation speed in response to the electric motor 20, the controller 10 recognizes that the activation of the electric oil pump 18 has been successful and then continues the running of the electric oil pump 18 as shown in step S108 in FIG. 2. The electric oil pump 18 circulates the cooling oil 15 in the oil pan 16 through the motor 13 to cool the motor 13.

On the other hand, when the electric motor 20 cannot rotate at the rotation speed equal to or greater than the predetermined rotation. speed in step S108 in FIG. 2, the controller 30 recognizes that the electric oil pump 18 cannot be activated because of some abnormality in the electric oil pump 18. The controller 30 then sets a flag to indicate that an abnormality has been detected in the electric oil pump 18 (judges the abnormality of the electric oil pump 18) as shown in step S109 in FIG. 2, and deactivates the electric oil pump 18 as shown in step S110 in FIG. 2.

When the oil temperature To detected by the sensor 21 is not equal to or greater than the first threshold (A) or the outside air temperature Ta detected by the sensor 22 is not equal to or greater than the second threshold (B) in step S103 shown in FIG. 2; that is, when the oil temperature To and the outside air temperature Ta are out of the region (I) shown in FIG. 3, the controller 30 proceeds to step S104 in FIG. 2. The controller 30 again executes the electric oil pump actuation permitting program 37 and permits the actuation of the electric oil pump 18 as shown in step S111 in FIG. 2 in a case (second case; here, a third threshold (C) is greater than the first threshold (A), C>A) where the outside air temperature Ta detected by each of the sensors 21 and 22 is less the second threshold (B) and where the oil temperature To is equal to or greater than the third threshold (C); that is in a case where the oil temperature To and the outside air temperature Ta are not included in the region (I) shown in FIG. 3 but are included in a region (II). The region (II) corresponds to the following situation: The temperature inside the transaxle assembly 10 which reaches a temperature of several ten degrees or more during traveling remains at a certain degree of temperature even if a given length of time has passed since the deactivation of the electric vehicle 200; for example, when a given length of time has passed since the deactivation of the electric vehicle 200 in the case where the outside air temperature is extremely low. However, the temperatures of the electric oil pump 18 and the external pipe 17 that are disposed outside the transaxle assembly 10 drop in accordance with the low outside air temperature, and the oil temperature To of the cooling oil 15 therein also drops to a considerable degree. Even in this case, for example, if the motor 13 is activated, the temperature of the transaxle assembly 10 rises, and the temperature in the place located in the vicinity of the outside of the transaxle assembly 10 rises accordingly. Thus, the temperatures of the electric oil pump 18 and the external pipe 17 that are disposed outside the transaxle assembly 10 also rise and reach a temperature that is not as low as the outside air temperature, and the temperature of the cooling oil 15 therein may also become higher than the outside air temperature. Thus, the controller 30 permits the actuation of the electric oil pump 18 (finishes the electric oil pump actuation permitting program 37) as shown in step S111 in FIG. 2 in the as (the second case where the oil temperature To and the outside-air temperature Ta are in the region (II)) where the outside air temperature Ta detected by the sensor 22 is less the second threshold (B) and where the oil temperature To detected by the sensor 21 is equal to or greater than the third threshold (C).

For example, when the temperature of the motor 13 has risen and the cooling of the motor 13 is needed, the controller 30 executes the electric oil pump abnormality judging program 38 shown in FIG. 1. The controller 30 outputs an electric oil pump activation instruction as shown in step S112 in FIG. 2. An electric current runs through the electric motor 20 under the electric oil pump activation instruction, and the electric motor 20 starts rotating. When the electric oil pump 18 rotates at a rotation speed equal to or greater than a rotation speed in response to the electric motor 20, the controller 30 recognizes that the activation of the electric it coma 18 has been successful and then continues the running of the electric oil pump 18 as shown in step S113 in FIG. 2. The electric oil pump 18 circulates the cooling oil 15 in the oil pan 16 through the motor 13 to cool the motor 13.

On the other hand, when the electric motor 20 cannot rotate at the rotation speed equal to or greater than the predetermined rotation speed in step S113 in FIG. 2, the controller 30 recognizes that the electric oil pump 18 cannot be activated because of the low temperature and high viscosity of the cooling oil 15, and judges that the electric oil pump 18 has no abnormality. The controller 30 then continues the actuation of the electric oil pump 18 as shown in step S115 in FIG. 2 without setting a flag to indicate that an abnormality has been detected in the electric oil pump 18 (without judging the abnormality of the electric oil pump 18) as shown in step S114 in FIG. 2. As the temperature of the transaxle assembly 10 rises in response to the activation of the motor 13, the temperatures of the electric oil pump 18 and the external pipe 17 and the oil temperature To of the cooling oil 15 therein also rise, and the viscosity may have reached a viscosity which enables the activation of the electric oil pump 18 and which enables the cooling oil 15 inside the external pipe 17 to be sucked into the electric oil pump 18.

As shown in step S116 in FIG. 2, the controller 30 then judges whether there are other conditions that require the deactivation of the electric oil pump 18; for example, an overcurrent to the electric motor 20 or the step-out of the electric motor 20. If there are no other conditions that require the deactivation of the electric oil pump 18, the controller 30 returns to step S113 in FIG. 2 and then continues the actuation of the electric oil pump 18. If the rotation speed of the electric oil pump 18 has become equal to or greater than the predetermined rotation speed in step S113 in FIG. 2, the controller 30 then continues the running of the electric oil pump 18. When other conditions that prevent the activation of the electric oil pump 18 are satisfied in step S116 in FIG. 2, the controller 30 deactivates the electric oil pump 18 as shown in step S117 in FIG. 2. Even in this case, the controller 30 does not set a flag to indicate that an abnormality has been detected in the electric oil pump 18 (the controller 30 does not judge the abnormality of the electric oil pump 18). Therefore, the controller 30 can perform a next activation operation as usual (finishes the electric oil pump abnormality judging program 38).

The controller 30 proceeds to step S105 in FIG. 2 when the oil temperature To detected by the sensor 21 is not equal to or greater than the first threshold (A) and the outside air temperature Ta detected by the sensor 22 is not equal to or greater than the second threshold (B) in step S103 shown in FIG. 2; that is, when the oil temperature To and the outside air temperature Ta are out of the region (I) shown in FIG. 3 and when the outside air temperature Ta is not less than the second threshold (B) and the oil temperature To is not equal to or greater than the third threshold (C) in step S104 shown in FIG. 2; that is, when the oil temperature To and the outside air temperature Ta are included neither in the region (I) shown in FIG. 3 nor in the region (II). The controller 30 again executes the electric oil pump actuation permitting program 37 and permits the actuation of the electric oil pump 18 as shown in step S111 in FIG. 2 in a case (third case; here, a fourth threshold (D) is greater than the second threshold (B) D>B) where the oil temperature To detected by The sensor 21 and 22 is less than the first threshold (A) and where the outside air temperature Ta detected by the sensor 22 is equal to or greater than the fourth threshold (D) as shown in step S105 in FIG. 2; that is, In a case where The of temperature To and the outside air temperature Ta are not included in the region (I) and the region (II) shown in FIG. 3 but are included in a region (III) shown in FIG. 3. The region (III) corresponds to the following case: For example, the electric vehicle 200 is deactivated in a cold district at night, and the temperature inside the transaxle assembly 10 is low. Even if the outside it temperature Ta starts rising in the morning, the temperature inside the transaxle assembly 10 remains low. In this case, even if the oil temperature To of the cooling oil 15 retained in the oil pan 16 of the transaxle assembly 10 is a temperature lower than the first threshold (A), the temperatures of the electric oil pump 18 and the external pipe 17 that are disposed outside the transaxle assembly 10 become higher than the temperature of the transaxle assembly 10 in response to the rising of the outside air temperature Ta. Accordingly, the oil temperature To of the cooling oil 15 inside the electric oil pump 18 and the external pine 17 becomes higher, and its viscosity is low, so that it is assumed that the electric oil pump 18 can be activated and that the cooling oil 15 can be sucked into the electric oil bump 18 from the external pipe 17. Thus, the controller 30 permits the actuation of the electric oil pump 18 (finishes the electric oil pump actuation permitting program 37) as shown in step S111 in FIG. 2 in the case (the third case) where the oil temperature To detected by the sensor 21 is less than the first threshold (A) and where the outside air temperature Ta detected by the sensor 22 is equal to or greater than the fourth threshold (D); that is, in the case where the oil temperature To and the outside air temperature Ta are included in the region (III) shown in FIG. 3.

As has been previously described, the controller 30 executes the electric oil pump abnormality judging program 38 shown in FIG. 1, for example, when the temperature of the motor 13 has risen and the cooling of the motor 13 is needed. The controller 30 activates the electric oil pump 18 as shown in steps S112 to S117 in FIG. 2, and continues the operation of the electric oil pump 18 when the activation of the electric oil pump 18 has been successful. When the electric oil pump 18 cannot be activated, the controller 30 recognizes that the electric oil pump 18 cannot be activated because of the to temperature and high viscosity of the cooling oil 15, and judges that the electric oil pump 18 has no abnormality. The controller 30 then continues the actuation. of the electric oil pump 18 without setting a flag to indicate that an abnormality has been detected in the electric oil pump 18 (without judging the abnormality of the electric oil pump 18), and the controller 30 continues the actuation of the electric oil pump 18 until the electric oil pump 18 can be activated. However, when other conditions that prevent the activation of the electric oil pump 18 are satisfied, the controller 30 deactivates the electric oil pump 18. Even in this case, the controller 30 does not set a flag to indicate that an abnormality has been detected in the electric oil pump 18 (the controller 30 does not judge the abnormality of the electric oil pump 18). Therefore, the controller 30 can perform a next activation operation as usual (finishes the electric oil pump abnormality judging program 38).

The controller 30 judges that the oil temperature To and the outside air temperature Ta are included in a region (IV) in a case (none of the first, second, and third cases) where the oil temperature To and the outside air temperature Ta detected by the respective sensors 21 and 22 are applicable to none of the conditions shown in steps S103 to S105 in FIG. 2; that is, in a case where the oil temperature To and the outside air temperature Ta are included in none of the regions (I) to (III) shown in FIG. 3. The region (IV) corresponds to the following situation: Both the oil temperature To of the cooling oil 15 inside the transaxle assembly 10 and the oil temperature To inside the electric oil pump 18 and the external pipe 17 that are disposed outside the transaxle assembly 10 are low, and the viscosity is high, so that the electric oil pump 18 cannot be activated. Therefore, the controller 30 executes the electric oil pump actuation permitting program 37 shown in FIG. 1, and inhibits IS the actuation of the electric oil pump 18 as shown in step S218 in FIG. 2. As a result, for example, even if some conditions are satisfied, no instruction to activate the electric oil pump 18 is output, so that the electric oil pump 18 is not activated (the electric oil pump actuation permitting program 37 is finished).

As described above, the regions (I) to (III) that enable the activation of the electric oil pump 18 are set by the combination of the oil temperature To of the cooling oil and the outside air temperature Ta detected by the oil temperature sensor 21 and the outside air temperature sensor 22. In the regions (II) and (III) in particular, the controller 30 continues the actuation of the electric oil pump 18 without setting a flag to indicate that an abnormality has been detected in the electric oil pump 18 (without judging the abnormality of the electric oil pump) when the electric oil pump 18 cannot be activated. Therefore, the region that enables the activation of the electric oil pump 18 can be widened. In the regions (II) and (III), the abnormality of the electric oil pump 18 is not detected the abnormality of the electric oil pump 18 is not judged) when the electric oil pump 18 cannot be activated. Therefore, it is possible to reduce the detection of the abnormality (fault) of the electric oil pump 18 (erroneous detection of an abnormality (fault)) when the electric oil pump 18 is not abnormal and when the electric oil pump 18 cannot be activated because of the low temperature and high viscosity of the cooling oil 15.

In the embodiment described above, the electric oil pump actuation permitting program 37 is executed to judge permission for the activation of the electric oil pump 18. However, for example, a region map based on the oil temperature To of the cooling oil and the outside air temperature Ta shown in FIG. 3 may be stored in the control data 36 shown in FIG. 1, and the oil temperature To of the cooling oil and the outside air temperature Ta that have been detected may be used for the region judgment to permit the actuation of the electric oil pump 18.

The present invention is not limited to the embodiment described above, and all changes and modifications that fall within the technical scope and spirit of the invention defined by the claims are intended to be embraced.

The invention claimed is:

1. A cooling system comprising:

an electric oil pump which is disposed outside a case of a vehicle driving motor and which circulates cooling oil through the motor;

an outside air temperature sensor which detects an outside air temperature;

an oil temperature sensor which detects an oil temperature of the cooling oil in the case; and a controller which determines permission for the actuation of the electric oil pump and which activates the electric oil pump and determines whether there is an abnormality in the electric oil pump, wherein the electric oil pump and the case are connected by an external pipe outside the case, wherein the controller actuates the electric oil pump only in one of:

a first case where the oil temperature detected by the oil temperature sensor is equal to or greater than a first threshold and where the outside air temperature detected by the outside air temperature sensor is equal to or greater than a second threshold, a second case where the outside air temperature is less than the second threshold and where the oil temperature is equal to or greater than a third threshold higher than the first threshold, and a third case where the oil temperature is less than the first threshold and where the outside air temperature is equal to or greater than a fourth threshold higher than the second threshold, and wherein:

the controller determines whether a rotation speed of the electric oil pump is equal to or greater than a predetermined rotation speed, and when the rotation speed of the electric oil pump is not equal to or greater than the predetermined rotation speed in the second and third cases, the controller continues an activation instruction of the electric oil pump without determining that there is an abnormality in the electric oil pump.

2. The cooling system according to claim 1, wherein, when the rotation speed of the electric oil pump is not equal to or greater than the predetermined rotation speed in the first case, the controller deactivates the electric oil pump and determines that there is an abnormality in the electric oil pump.

3. An operation method of an electric oil pump in a cooling system, the cooling system comprising an electric oil pump which is disposed outside a case of a vehicle driving motor and which circulates cooling oil in the case through the motor, an outside air temperature sensor which detects an outside air temperature, and an oil temperature sensor which detects an oil temperature of the cooling oil in the case, the electric oil pump and the case being connected by an external pipe outside the case, the method comprising actuating the electric oil pump only in one of:

a first case where the oil temperature detected by the oil temperature sensor is equal to or greater than a first threshold and where the outside air temperature detected by the outside air temperature sensor is equal to or greater than a second threshold, a second case where the outside air temperature is less than the second threshold and where the oil temperature is equal to or greater than a third threshold higher than the first threshold, and a third case where the oil temperature is less than the first threshold and where the outside air temperature is equal to or greater than a fourth threshold higher than the second threshold, determining whether a rotation speed of the electric oil pump is equal to or greater than a predetermined rotation speed, and when the rotation speed of the electric oil pump is not equal to or greater than the predetermined rotation speed in the second and third cases, continuing an activation instruction of the electric oil pump without determining that there is an abnormality in the electric oil pump.

4. The operation method according to claim 3, further comprising, when the rotation speed of the electric oil pump is not equal to or greater than the predetermined rotation speed in the first case, deactivating the electric oil pump and determining that there is an abnormality in the electric oil pump.

* * * * *